United States Patent [19]

David et al.

[11] Patent Number: 4,765,441

[45] Date of Patent: Aug. 23, 1988

[54] INDUSTRIAL TRUCK, PARTICULARLY HIGH-LIFT TRUCK, ALSO AS A HIGH-LIFT TRUCK HAVING A DISPLACEABLE MAST

[75] Inventors: Bernd David, Henstedt-Ulzburg; Alfred Klingberg, Norderstedt, both of Fed. Rep. of Germany

[73] Assignee: Jungheinrich Unternehmensverwaltung KG, Hamburg, Fed. Rep. of Germany

[21] Appl. No.: 51,936

[22] Filed: May 19, 1987

Related U.S. Application Data

[63] Continuation of Ser. No. 824,159, Jan. 30, 1986, Pat. No. 4,709,786.

[30] Foreign Application Priority Data

Feb. 1, 1985 [DE] Fed. Rep. of Germany ..... 3503359
Aug. 19, 1985 [DE] Fed. Rep. of Germany ..... 3529601

[51] Int. Cl.[4] ..... B66B 9/20

[52] U.S. Cl. ..... 187/9 E; 187/95; 414/631

[58] Field of Search ..... 187/9 E, 9 R, 95; 414/628, 629, 630, 631; 182/141; 384/44, 50

[56] References Cited

U.S. PATENT DOCUMENTS 3,556,247 1/1971 Shinoda ..... 187/9 E
3,851,732 12/1974 Wagner et al. ..... 187/9 E

*Primary Examiner*—Joseph J. Rolla
*Assistant Examiner*—Kenneth Noland
*Attorney, Agent, or Firm*—Toren, McGeady & Associates

[57] ABSTRACT

An industrial truck, particularly a high-lift truck, comprising a lifting frame provided with extensible mast sections and a load-carrying carriage, is provided on the fixed mast section and, if desired, on extensible mast sections, with laterally disposed vertical rails, which serve in alternation as carriers for rotatably mounted guide roller for engaging guideways on adjacent rails or to provide guideways for such guide rollers. The guideways are provided at least on one side with a bordering ledge for the lateral guidance of the guide rollers. At least part of the guide rollers (20, 22, 30; 24, 26, 27, 28; 102–104; 105; 106; 108, 109; 143), particularly those disposed on one side of the lifting frame (2), are axially displaceable. In one embodiment the guide rollers (20, 22; 24) disposed on one side of the lifting frame are axially displaceable in their bearings and those (19, 21; 23, 25) disposed on the other side of the lifting frame are axially fixed in their bearings. In another embodiment an axial displacement is permitted in that the guideways (127–129) for the associated guide rollers (20, 22, 30; 20', 22', 30'; 24–27, 65, 143) disposed on one side of the lifting frame (2) are wider than the treads of the associated guide rollers and said guide rollers are axially fixed in their bearings.

2 Claims, 14 Drawing Sheets

INDUSTRIAL TRUCK, PARTICULARLY HIGH-LIFT TRUCK, ALSO AS A HIGH-LIFT TRUCK HAVING A DISPLACEABLE MAST

This is a continuation of application Ser. No. 824,159, filed Jan. 30, 1986, now U.S. Pat. No. 4,709,786.

BACKGROUND OF THE INVENTION

1. Field of the Invention

This invention relates to an industrial truck, particularly a high-lift truck, also as a high-lift truck having a displaceable mast.

The invention relates generally to an industrial truck and particularly to a high-lift truck, which truck comprises a lifting frame, particularly a frame comprising extensible mast sections and at least one vertically movable load-carrying carriage, wherein the fixed mast section and any extensible mast section are provided each with laterally disposed, vertical rails, which serve in alternation as carriers for rotatably mounted guide rollers for engaging guideways of adjacent rails or as guideways for such guide rollers, wherein guide rollers are provided on the load-carrying carriage and particularly at the top end of a lower or outer mast portion or of an extensible mast section, and at the bottom end of an inner extensible mast section, and the guideways are provided at least on one side with a bordering ledge for laterally guiding the guide rollers.

The term "industrial truck" and "high-lift truck" include high-lift trucks having a displaceable mast and provided with laterally disposed, inwardly open guide rails for a lifting frame carrier, which carries guide rollers running in the guide rails.

The invention covers also industrial high-lift trucks having a displaceable mast and inwardly open horizontal guide rails for guiding guide rollers which are axially fixed in bearings on the lifting frame.

The invention is alsp applicable to vehicles having an inclinable mast.

In such vehicles, the mast may be moved to an inclined position for transport trips so that loads will be more reliably held, e.g., on fork prongs of the load-carrying carriage.

Such lifting frame may consist of a fixed or lower mast section, in which only one load-carrying carriage is guided, or with a lower or fixed mast section and extensible mast sections. The mast may consist of three or two sections.

2. Description of the Prior Art

Such lifting frames are known, e.g., from Published German Application No. 3,041,821. A problem arising in connection with such lifting frames resides in that the individual mast sections, particularly extensible mast sections, should be guided not only in forward and rearward directions but should also be laterally guided. It is known to provide rollers which are offset 90° for a lateral guidance. But such rollers involve a considerable expenditure and particularly if the lateral struts of the mast sections consist of rails such roolers will require additional space. Besides, said rollers add to the weight of those mast parts which are to be moved.

Extensible mast sections have, on an average, a length of about two to three meters. This fact gives rise to problems. The side portions of the mast sections, i.e., the laterally disposed rails for the guide rollers, which are rotatably mounted in fixed positions in known manner, have previously required to be exactly aligned so that loads can uniformly be taken up by all rollers. The mast sections must be manufactured with very accurate parallelism. But tolerances of such components are inevitable so that expensive adjusting work is required and special means must be provided for such adjustments.

It will be understood that the lifting frame may be provided with drive means, such as laterally or centrally disposed cylinder-piston units, for extending vertically movable mast sections. In such arrangements it is known to provide drive chains between mast sections which are guided on each other and may consist of extensible mast sections, and said chains may be so arranged that when a vertically movable part of the lifting frame has been extended by directly acting drive means, other parts will be carried along as the extending operation of the drive means is continued, e.g., when the driven part is a load-carrying carriage and has reached its top position in the mast section in which said carriage is guided. Such extending drives are known and may be included within the scope of the invention in any known form. Attention is directed, e.g., to German Patent Specification No. 1,041,864 disclosing a three-part mast.

A particularly high expenditure will be involved in known arrangements in the maintaining of exact tolerances if guideways for guide rollers are formed by C sections, which confine the guide rollers also on their sides by bordering ledges in order to prevent a transverse canting, as is disclosed in German Patent Specification No. 1,273,422. Such a design will adversely affect the operation because the rollers may be seized. Such lifting frames are particularly unsuitable for lateral stacking operations.

From U.S. Pat. No. 2,321,029 it is also known to provide for an engagement between guide rollers and the associated guideways on profiled surfaces, e.g., by the provision of grooved surfaces on the treads of the guide rollers and of guideways provided with bordering ledges which have a mating shape in cross-section.

The term "bordering ledge" covers also laterally disposed external rails or webs which are provided at the guideways and border a guide roller on the outside in the same manner as a so-called C section.

SUMMARY OF THE INVENTION

It is an object of the invention to provide a lifting frame which is designed for a simpler manufacture and a simpler adjustment for operation.

In a special embodiment another object is to permit the use of conventional bearings for the guide rollers.

The manufacture will be simplified if larger tolerances are permissible and will not adversely affect the quality of the lifting frame as regards the guidance of mast sections which are movable relative to each other.

That object is accomplished in accordance with the invention in that at least part of the guide rollers, particularly guide rollers disposed on one side of the lifting frame, are axially displaceable. This arrangement will permit a compensation particularly of lateral tolerances whereas a lateral guidance is maintained because in different embodiments the guide rollers disposed on one side of the lifting frame are axially displaceable in their bearings and those disposed on the other side of the lifting frame are axially fixed in their bearings, or, in another desirable embodiment, additional guide rollers are provided in an intermediate portion of the mast in a plane which is parallel to the transverse direction of the mast.

The invention does not only simplify the manufacture because problems due to tolerances resulting in a lateral backlash will be avoided but will also reduce the requirements regarding the exact alignment of the guides, particularly of the laterally disposed vertical rails, and the need for a special adjustment of a laterally disposed guide will be eliminated.

In the preferred embodiment, the bordering ledges constitute laterally disposed guides and the guide rollers provided on one side of the lifting frame are axially displaceable in their bearings whereas those disposed on the other side of the lifting frame are axially fixed in their bearings.

In another desirable embodiment, guide rollers provided on the load-carrying carriage on both sides are axially displaceable in their bearings.

With such an arrangement a desirable guidance and a satisfactory rolling contact can be achieved particularly at the load-carrying carriage. It must be borne in mind that all rollers for guiding the load-carrying carriage are mounted on the latter rather than in alternation, as is the case with the guide rollers between different mast sections. In order to ensure a satisfactory lateral alignment also in such embodiment, the load-carrying carriage is desirably provided on one side with an axially fixed guide roller, which is disposed below an upper guide roller and runs in a rail having a laterally disposed bordering ledge.

The guide rollers which are axially displaceable in bearings of the load-carrying carriage are suitably disposed on that side of the lifting frame on which guide rollers which are axially fixed in their bearings are disposed between the mast sections.

In an embodiment in which the sections of the lifting frame, such as a fixed mast section and extensible mast sections, are provided with cross-braces between side rails and with vertical rails connected to said cross-braces, and in which said rails consist of channel members which are open toward the cross-braces of an adjacent mast section and all channel rails, except those of the fixed mast section, are provided with bearing brackets, which extend from the web and cooperate with guide rollers which are guided in the channel of the adjacent mast section, as is known from Published German Application No. 3,041,821, the guide rollers are preferably axially displaceably mounted on the bearing brackets and a bordering ledge for a guidance of guide rollers is provided at least on one side, always on the same side on the channel rails mounted on the cross-brace. In such an arrangement all guide rollers between the extensible mast sections and, if desired, between an extensible mast section and the fixed mast section and between an extensible mast section and the load-carrying carriage are desirably axially displaceable in their bearings.

The above-mentioned embodiment consisting of a high-lift truck having a displaceable mast may preferably be designed so that the guide rails for the mast carrier are provided at least at their top edges with bordering ledges and the guide rollers mounted on the mast carrier on one side are axially displaceable in their bearings and those mounted on the mast carrier on the other side are axially fixed in their bearings. In that case bearings in which the guide rollers are axially fixed and axially displaceable, respectively, are provided on parts other than the lifting frame and particularly on the carrier for the lifting frame so that the advantages mentioned hereinbefore are afforded for such other parts too.

The carrier for the lifting frame is suitably provided with rotatably mounted backing rollers, which roll on the top of guide rails provided on the horizontal arms of the mast carrier.

In connection with the additional object mentioned hereinbefore, a lateral wandering is to be permitted in spite of the use of conventional bearings. This is also applicable to an arrangement in which each guide roller is mounted on its axle or on a shaft in an axially fixed position so that very simple bearings can be used for that purpose.

Also in connection with that additional object, the guideways which are provided on one side of the lifting frame cooperate with guide rollers which are axially fixed in their bearings and said guideways are wider than the treads of the associated guide rollers. This results in a combination in which all guide rollers are axially fixed in their bearings and the guide rollers disposed on one side of the lifting frame can wander relative to the associated guideways. Such an arrangement will permit a compensation of tolerances, particularly of lateral tolerances, whereas a lateral guidance is still ensured because in different embodiments one guide rollers of each pair thereof is guided at least on one side by guideways provided with bordering ledges so that said guide rollers are undisplaceable in a lateral direction.

That embodiment permits of a simpler manufacture because problems regarding tolerances involving a lateral backlash will be avoided and the requirements regarding the exact alignment of the guideways, particularly of the laterally disposed, vertical guides, may be less stringent. There is no need for a special adjustment of lateral guiding means and no probles or difficulties regarding the bearings for the guide rollers as such will arise in that connection.

In view of the above aspects it is preferred in a particularly desirable embodiment to provide the guideways on both sides of the lifting frame with bordering ledges which rise from the rolling contact surfaces and the tread of each guide roller disposed on one side is narrower than the associated rolling contact surface defined by the bordering ledge. In that case the guideways provided on the lifting frame and all extensible mast sections thereof may be perfectly identical and the above-described adaptation for a compensation of tolerances can be effected in conjunction with the provision of identical bearings for all guide rollers.

In another embodiment, which is also highly desirable, guide rollers running on guideways provided with bordering ledges are provided only on one side of the lifting frame and the guideways for the guide rollers disposed on the other side are not provided with bordering ledges and are inwardly open to permit a lateral wandering of the associated guide roller.

All treads of the guide rollers disposed on both sides of the lifting frame may have the same width and the guide rollers can wander laterally and the load per unit of area will be the same everywhere when the above-described tolerances have been taken up. The provision of guide rollers of equal width is desirable.

In a preferred embodiment of a high-lift truck having a displaceable mast, the guide rollers for the displaceable mast are movably guided on one side of the truck in a laterally disposed rail to be movable transversely to the longitudinal axis of the vehicle and the guide rollers disposed on the other side of the truck are guided to be undisplaceable transversely to said longitudinal axis. Such an arrangement will facilitate the compensation of lateral tolerances. Regarding the corresponding design of the extensible mast sections, the means for guiding the displaceable mast may provide for a freedom of movement on the same side or on another side.

In a preferred embodiment of a high-lift truck having a displaceable mast, one laterally disposed guide rail is provided with flanges which are flat as far as to their inner edge and form guideways which permit of a lateral wandering of the associated guide rollers. The stability of the mast structure will not be adversely affected by such a design because a defined guidance is provided on the other side.

The advantage residing in the use of identical guide rails will be afforded in a different embodiment, in which both laterally disposed guide rails for the mast carrier are provided with bordering ledges and each of the guide rollers provided on one side of the truck has a tread which is narrower than the guideway defined on a flange by a bordering ledge.

One principle, bordering ledges need not be provided on guide rails disposed on that side on which the guide rollers are disposed which have treads which are narrower than would correspond to the width of a guideway defined by a bordering ledge.

BRIEF DESCRIPTION OF THE DRAWING

FIG. 2 is a view that is similar to FIG. 11 and shows a still further embodiment of the invention.

DESCRIPTION OF THE PREFERRED EMBODIMENTS

Figure 1:
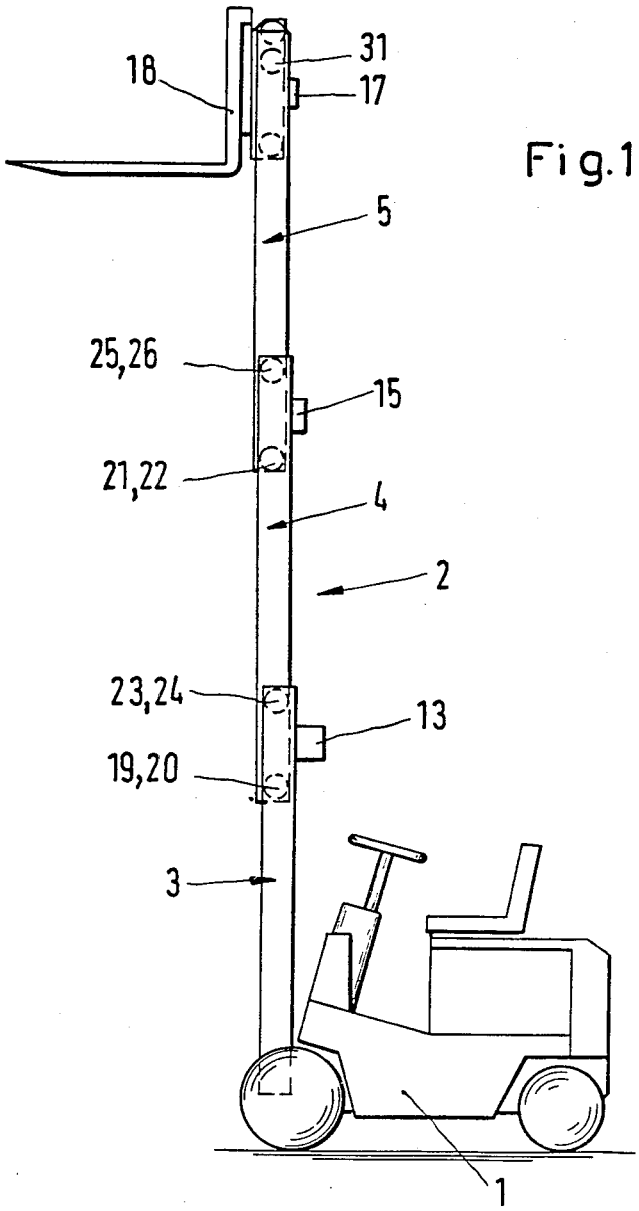
FIG. 1 is a diagrammatic side elevation showing a high-lift truck comprising a three-part mast in an extended position.

The invention will now be explained with reference to illustrative embodiments shown on the drawing.

Figure 2:
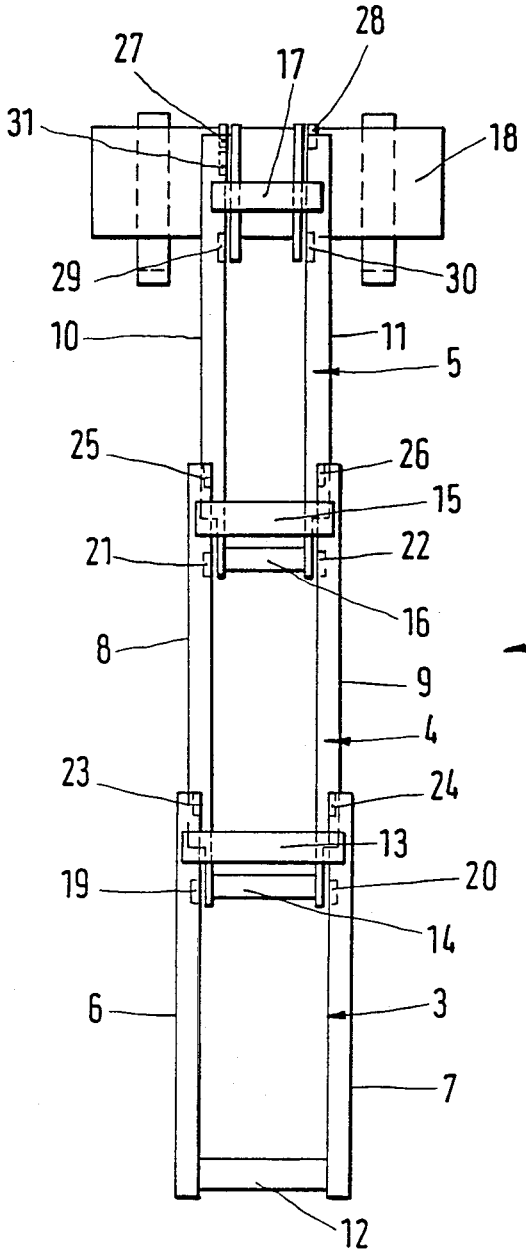
FIG. 2 is a diagrammatic rear elevation showing the lifting frame of FIG. 1.

The high-lift truck shown in FIGS. 1 and 2 comprises a lifting frame generally designated 2. The lifting frame comprises a three-part mast including a fixed mast section 3 and two extensible mast sections 4 and 5, which constitute inner mast sections disposed one in the other. All mast sections comprise laterally disposed, vertical rails 6, 7; 8, 9; 10, 11, which are interconnected by cross-braces 12, 13; 14, 15; 16, 17. The latter are so arranged that they can move past each other as the mast is retracted. In the retracted mast, the extensible mast sections 4, 5 extend or telescope into the fixed mast section 3.

A load-carrying carriage 13 is mounted on and vertically movable along the uppermost extensible mast section 5.

The drive means are not shown in detail. They comprise cylinder-piston units in a manner known per se, as will be explained with reference to a diagrammatic representation.

The sections of the extended mast are guided on each other by pairs of guide rollers provided on each mast section. It is apparent that the extensible mast sections 4, 5 are provided with lower rollers 19, 20., 21, 22. Each outer mast section is provided at its top end with guide rollers 23, 24, or 25, 26. The mast sections are extended only to such an extent that they are still reliably guided on each other. A load placed on the load-carrying carriage 18 will apply a bending moment with the result that the lower rollers 19, 20., 21, 22 bear on the rear on the rails of the adjacent outer mast section and the upper rollers 23, 24., 25, 26 bear on the rear on the adjacent, relatively extensible mast sections. Such an arrangement is known.

The load-carrying carriage 18 is provided at its top and bottom with guide rollers 27, 28 and 29, 30, respectively, which are guided in the uppermost mast section 5. An overhanging load applied to the load-carrying carriage will cause the upper guide rollers 27, 28 of the load-carrying carriage to bear forwardly on the mast section 5 and will cause the lower guide rollers 29, 30 to bear rearwardly on the mast section 5. If the guide rails have the same design and are provided with profiled bordering ledges only on one edge, such an arrangement will result in an undefined lateral guidance for the guide rollers 27, 28 at the top of the load-carrying carriage if the so-called bordering ledges are provided at the rear edge of the vertical rails. In this connection the term "rear" is used to describe that side of the lifting frame on which the driver's seat of the high-lift truck 1 is disposed. In order to ensure also a satisfactory lateral guidance in the special embodiment, the load-carrying carriage 18 is provided on one side with an additional guide roller 31, which is axially fixed in its bearing and is so disposed that it rolls on a bordering ledge provided on the rear on a vertical rail of the uppermost mast section.

In such a lifting frame 2, the guide rollers 19, 23, 21, 25 which are disposed on that side between the mast sections and the guide roller 29 and the additional guide roller 31 are axially fixed in the bearings in which they are rotatably mounted. The guide rollers 20, 24, 22, 26 disposed on the other side are rotatably mounted in bearings in which they are axially displaceable and are guided by the bordering ledges provided on the rails. In this embodiment each of the guide rollers 27, 28 and 30 provided on the load-carrying carriage 18 is axially displaceable in its bearings.

This arrangement permits a compensation of tolerances.

Figure 3:
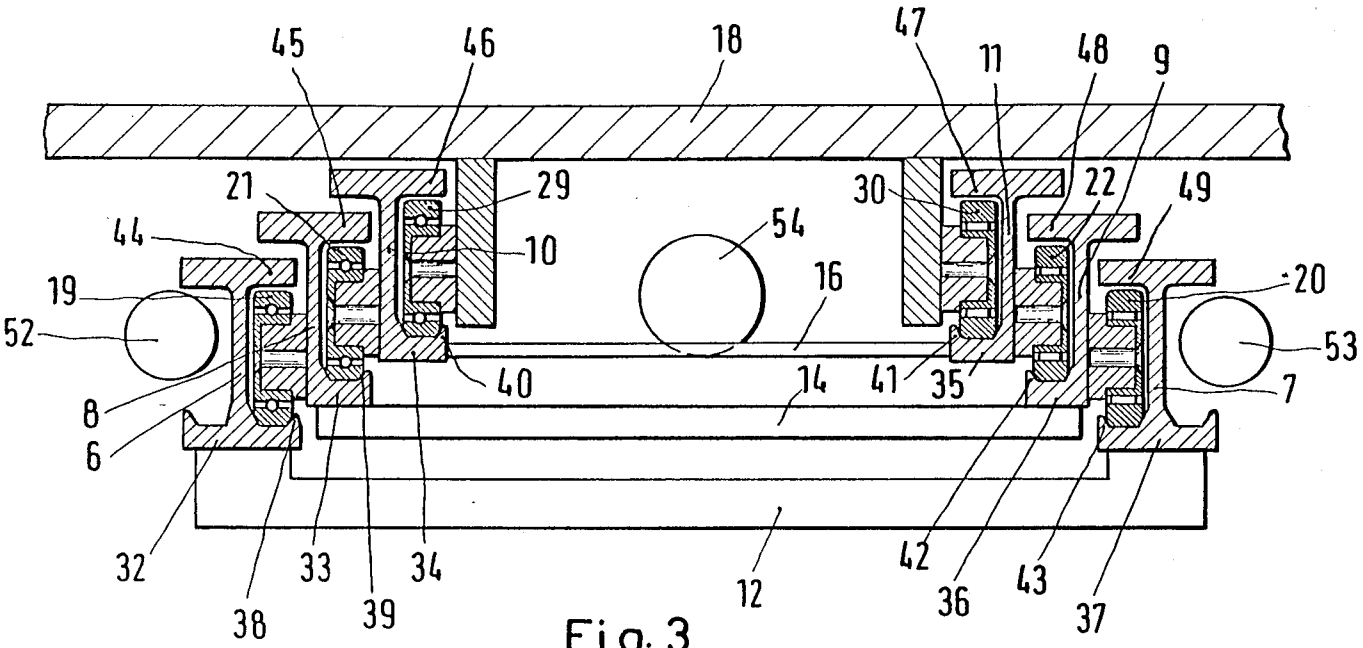
FIG. 3 is a sectional view showing the lifting frame of FIG. 1 in a retracted position, the section being taken in a plane in which the lower rollers of the several mast sections are disposed in that position.
Figure 4:
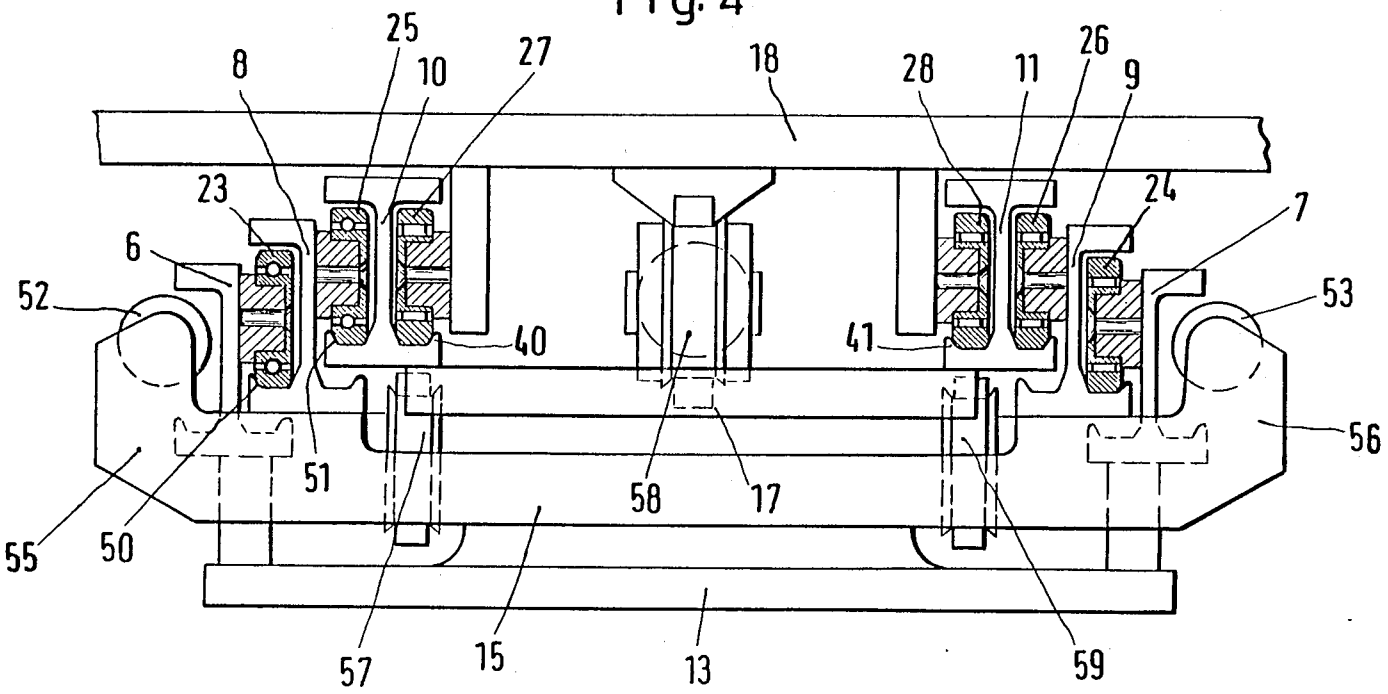
FIG. 4 is a sectional view that is similar to FIG. 3 but taken in the plane in which the upper rollers of the retracted mast are disposed.

The exact design is apparent from FIGS. 3 and 4, in which like parts are designated with the same reference characters. It is apparent that all rails of the mast sections are provided on the rear with flanges 32 to 37, which protrude at least on that side on which a guide roller is guided. Said flanges are provided with projecting ledges or upset portions, which constitute bordering ledges 38 to 43. On the other hand, the flanges 44 to 49 form smooth, flat guideways.

FIG. 3 shows the so-called lower guide rollers 19, 21 and 29 and 20, 22 and 30, which are mounted on the respective inner mast sections. FIG. 4 shows the upper rollers 24, 26 and 28 and 23, 25 and 27, which are mounted on the respective outer mast sections, with the exception of the rollers 29, 30 mounted on the load-carrying carriage.

It is also apparent from the sectional views in FIGS. 3 and 4 that the rollers 20, 22 and 30 and 24, 26, 28 disposed on one side are axially displaceable in their bearings and are held in position in the bearings by the lateral bordering ledges 41 to 43 so that each of said rollers runs on the associated rear flange 35 to 37. The bearings consist, e.g., of needle roller bearings. Those rollers 19, 21 and 29 and 23, 25 which are axially fixed in their bearings are axially fixed on the associated brackets of the adjacent guide rails so that their engagement with the lateral bordering ledges 38 to 40 and 50, 51 will ensure a lateral alignment of the mast sections relative to each other.

It is also apparent that on that side the lower roller 29 mounted on the load-carrying carriage 18 is also laterally fixed in its bearing whereas the upper portion of the load-carrying carriage is laterally guided by the additional guide roller 31.

It is apparent that the flanges of the rails 6 to 11 have lateral recesses so that the rollers extending into the rails toward different sides can protrude from the profiled contour in dependence on the elevations of the rollers.

In FIGS. 3 and 4, cylinder-piston units 52, 53 and 54 are diagrammatically shown, which effect the vertical movements in known manner. The cylinder-piston units 52 and 53 directly engage the abutments 55, 56 of the intermediate mast section 4. The cylinder-piston unit 54 cooperates with the load carrier 18. FIG. 4 shows also reversing sprockets 57, 58, 59 for drive chains by which the mast sections can be moved. The cylinder-piston units can be controlled in such a manner that the load-carrying carriage 18 can be lifted to some extent before the mast is extended.

Figure 5:
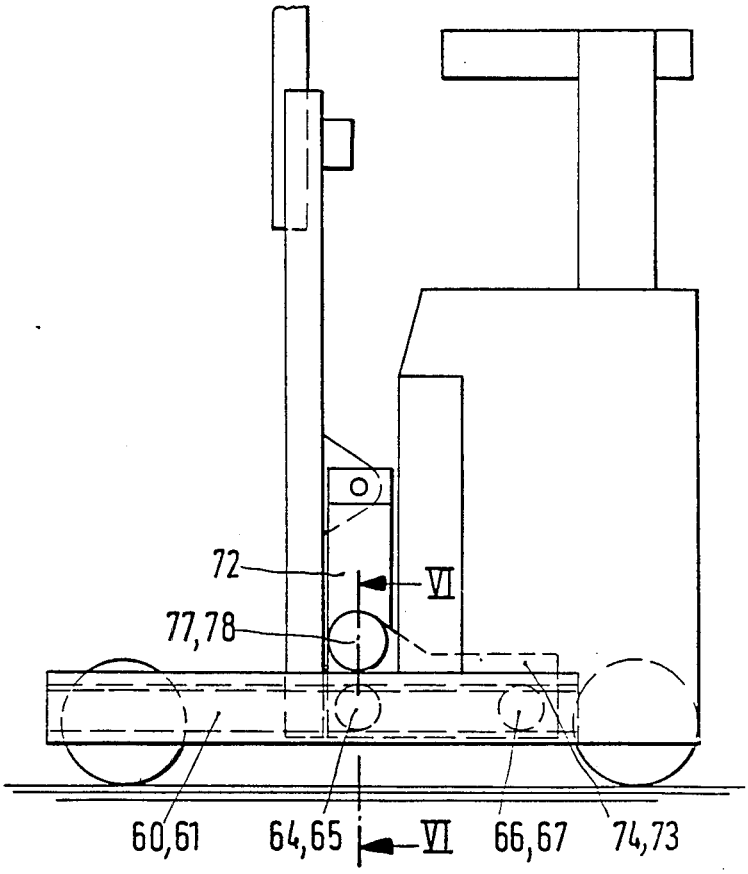
FIG. 5 is a fragmentary side elevation showing a portion of a high-lift truck having a displaceable mast.
Figure 6:
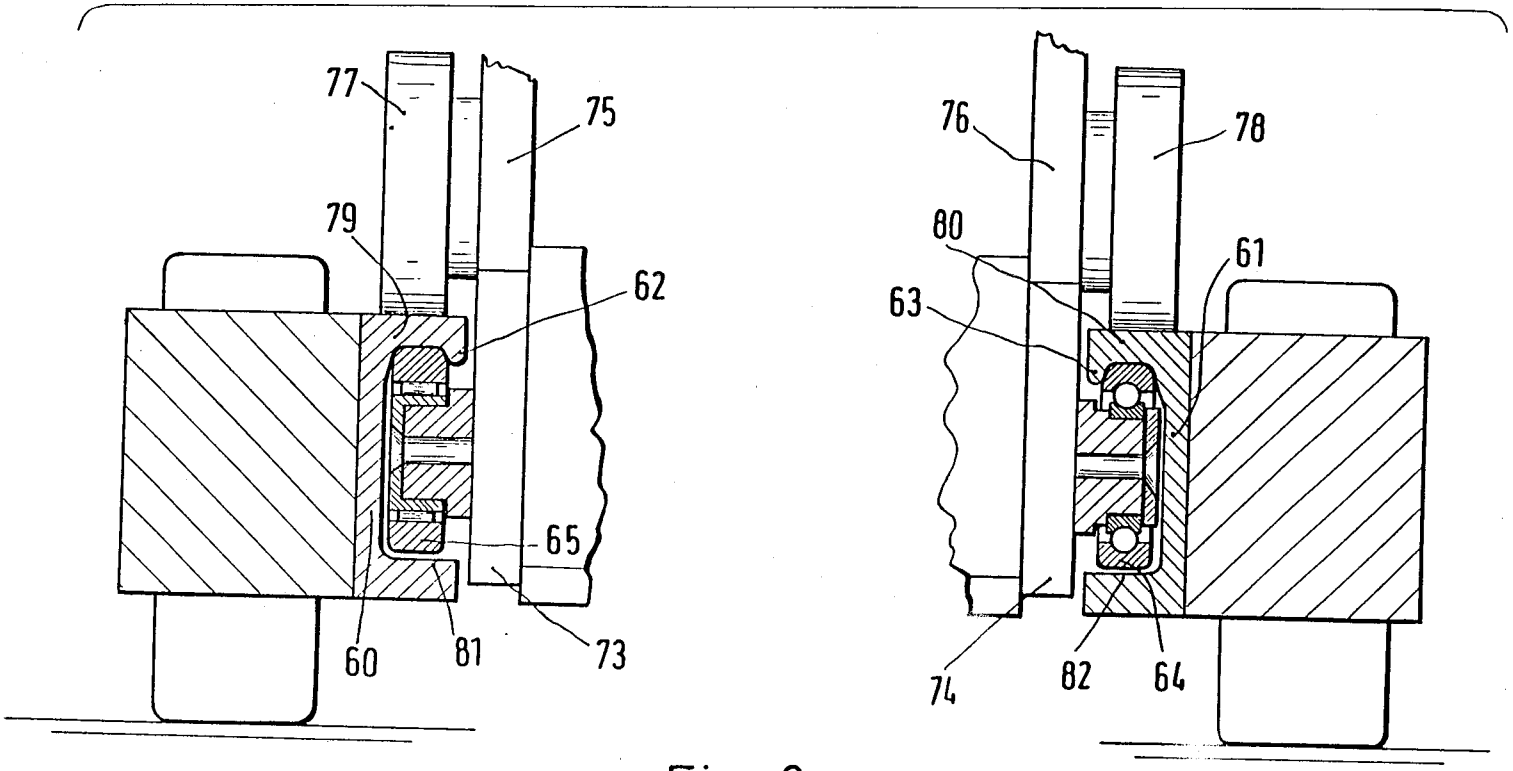
FIG. 6 is a diagrammatic fragmentary view, which is drawn on a larger scale than FIG. 5 and in which parts are broken away or shown in a section taken on line VI—VI in FIG. 5.

The high-lift truck having a displaceable mast shown in FIGS. 5 and 6 is provided in its chassis with laterally disposed, horizontal guide rails 60, 61, which are inwardly open and are provided on the inside surfaces of their top flanges with bordering ledges 62, 63. Guide rollers 64, 65; 66, 67 are guided by said guide rails. The guide rollers 64, 65 are shown also in FIG. 6. It is apparent that those of said guide rollers which are disposed on one side, e.g., the roller 65, are axially displaceable in their bearings, whereas those guide rollers which are disposed on the other side, e.g., the roller 64, are axially fixed in their bearings.

The guide rollers 64 to 67 are mounted on horizontal arms 73, 74 of the mast carrier 72, which has also vertical arms 75, 76, in which backing rollers 77, 78 are rotatably mounted, which roll on top of the guide rails 60, 61. Said backing rollers take up the load and ensure that the forward guide rollers 64, 65 will be held within the bordering ledges 62, 63 of the top flange 79, 80 of the guide rails 60, 61.

In that embodiment comprising guide rollers rolling within a bordering ledge, the respective other flange 44 to 49 or 81, 82 is smooth so that said rollers, just as the other guide rollers described, will not be seized when they assume an oblique position under load or as a result of manufacturing tolerances.

Figure 7:
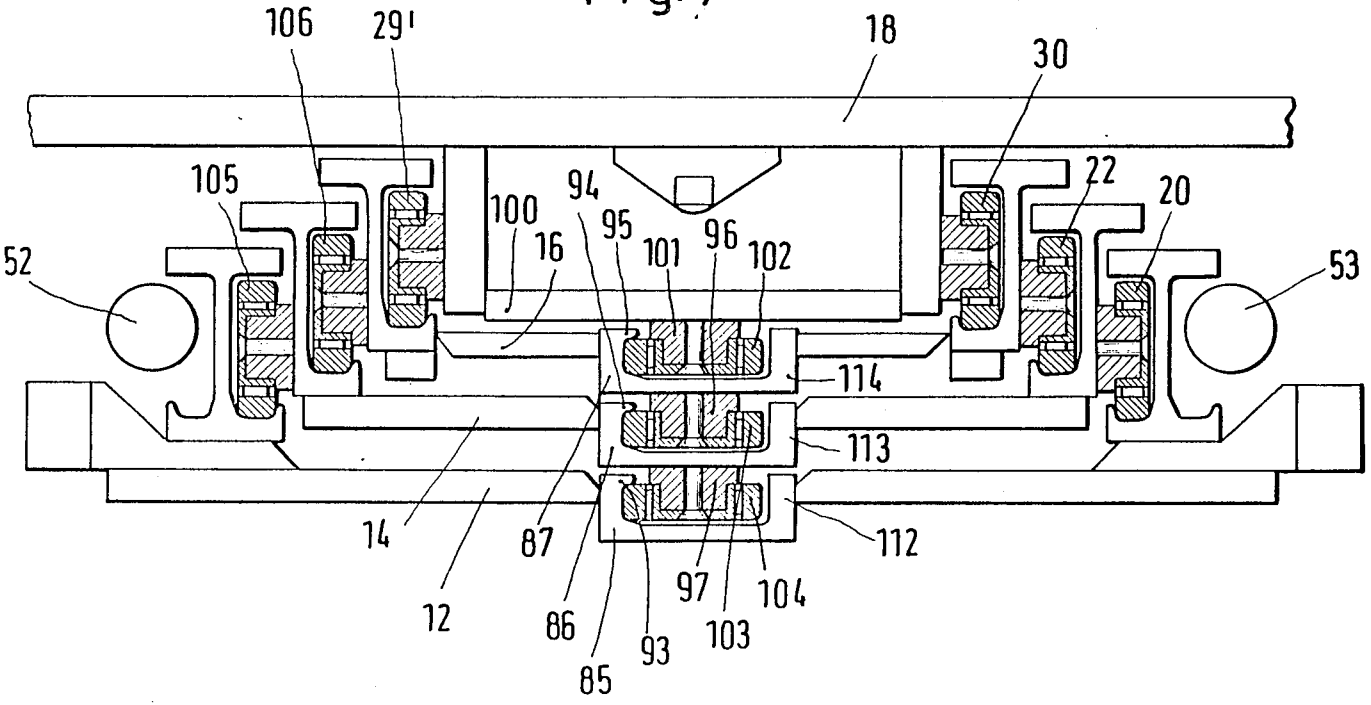
FIG. 7 is a view that is similar to FIG. 3 and shows a different mast.
Figure 8:
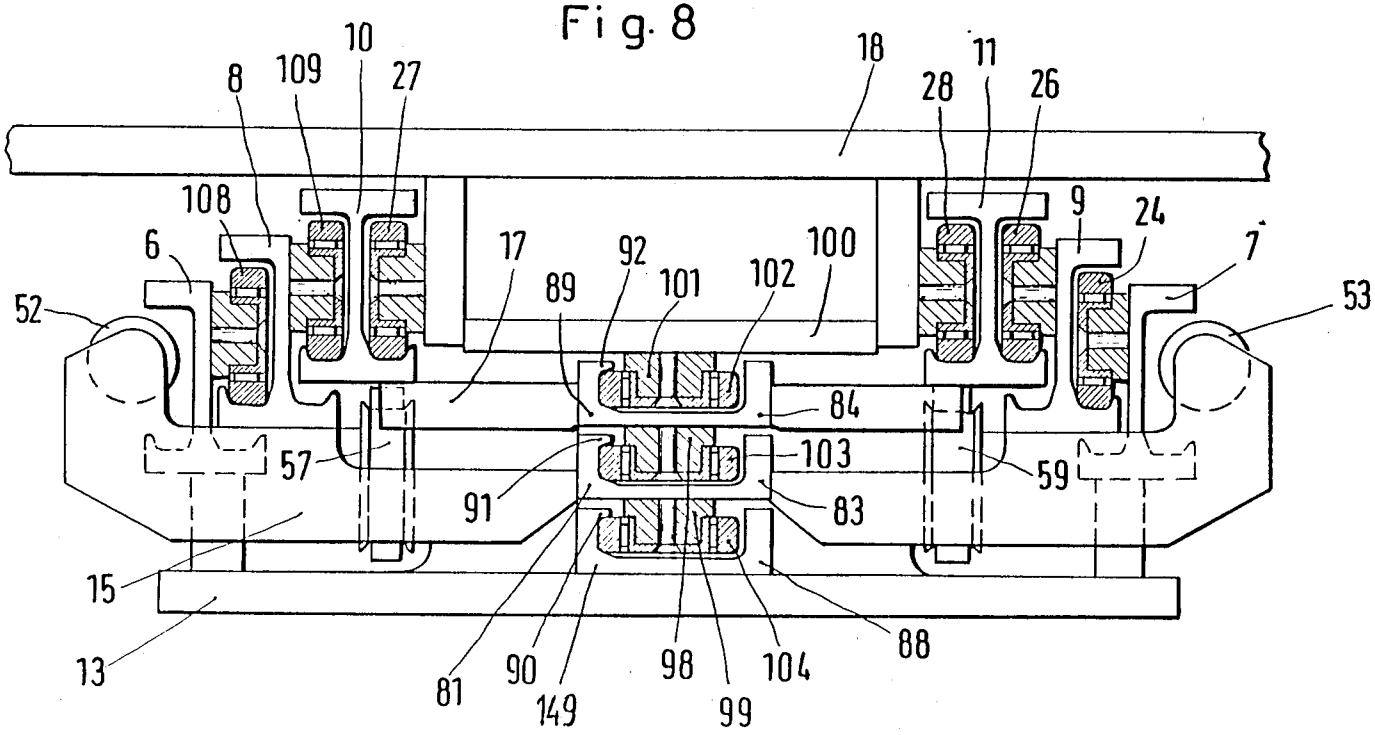
FIG. 8 is a view that is similar to FIG. 4 and shows that different mast.

FIGS. 7 and 8 are views which are similar to FIGS. 3 and 4 and are provided with the same reference characters for like elements. The cross-braces 12 to 17 comprise vertical rails 112 to 114 or 149, 83, 84, which constitute channels 85 to 87 or 88, 89 that are open on one side, in the present embodiment on the side facing the load-carrying carriage 18. Said channels are provided on one side with a bordering ledge 90 to 95. On the side facing away from the load-carrying carriage 18 said rails are provided with bearing brackets 96 to 99. An additional cross-brace 100 is provided on the load-carrying carriage 18 and comprises a bearing bracket 101, which extends into the adjacent channel member 87 to 89.

The guide rollers 102 to 104 mounted on said bearing brackets 96 to 99 and 101 are axially displaceable because the spacing of the cross-braces 12 to 17 is maintained by the laterally disposed guide rollers 20, 22, 30 and 24, 26, 28, which are axially displaceable, and by the guide rollers 105, 106 and 29' and 108, 109 and 27, which correspond to the guide rollers 19, 21, 29 and 23, 25, 27 in FIGS. 3 and 4 but are axially displaceable in their bearings.

In the embodiments shown in FIGS. 7 and 8, all guide rollers are axially displaceable in their bearings because the lateral quidance is effected by the raillike channel members on the cross-braces.

In the embodiment shown in FIGS. 7 and 8, the laterally disposed and axially displaceable guide rollers have laterally disposed bordering ledges associated with them in the manner which has been described with reference to FIGS. 3 and 4.

The embodiments are desirable because, as is apparent, a substantial part 6 to 9 of the vertical rails may have the same sectional shapes even if all angled profiled portions are not utilized.

The embodiments shown in FIGS. 7 and 8 provide for a lateral guidance with particularly high stability and owing to the provision of the intermediate vertical rails have a considerable strength and are lighter in weight. The last-mentioned embodiments constitute a particularly favorable solution to the tolerance problem.

In one embodiment of the lifting frame based on the design represented in FIGS. 1 and 2, the additional object will be accomplished by different embodiments of the means for compensating tolerances between mast sections of the lifting frame in conjunction with the provision of guide rollers which are rotatably mounted in bearings in which they are axially fixed. In such further embodiments the guide rollers 19, 23, 21, 25 provided between the mast section and the guide roller 29 and the additional guide roller 31 are rotatably mounted and axially fixed in their bearings and the guide rollers 20, 24, 22, 26 disposed on the other side are similarly mounted.

Figure 9:
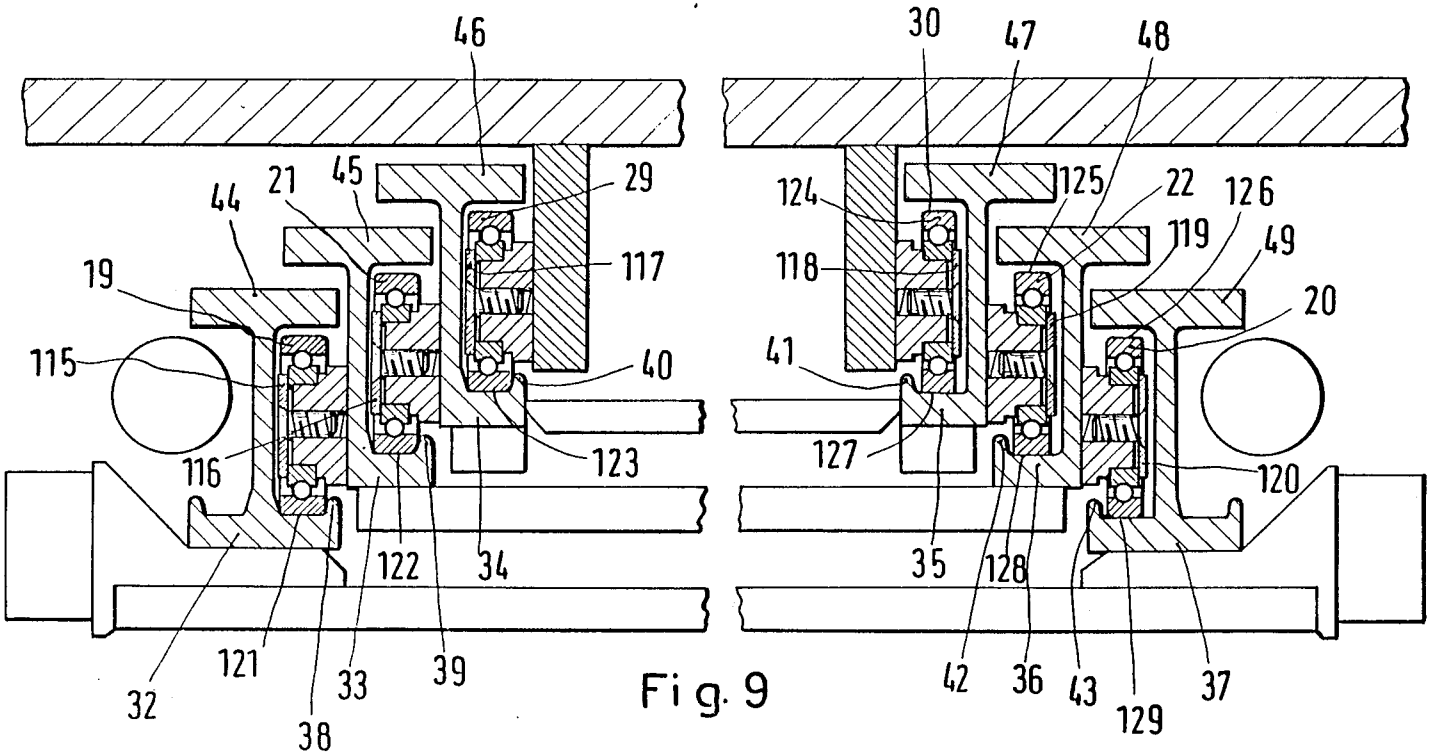
FIG. 9 is a sectional view showing the lifting frame of FIG. 1 in a retracted position, the section being taken in a plane in which the lower rollers of each mast section are disposed in that position.

In the embodiment shown in FIG. 9, a compensation of tolerances is ensured in that all rails of the mast sections are provided on the rear with flanges 32 to 37, which protrude at least on that side on which a guide roller is guided. Said flanges are provided with bordering ledges 38 to 43. The flanges 44 to 49 provided on the forward edges have laterally disposed, smooth, planar guideways.

It is apparent from FIG. 9 that the guide rollers 19 to 22 and 29, 30 disposed on both sides are axially fixed on their axles by end washers 115 to 120. Those guide rollers 19, 21 and 29 which are disposed on one side are held against lateral movement at their treads 121 to 123 by the bordering ledges 38 to 40.

The flanges 35 to 37 on the other side of the lifting frame are also provided with such bordering ledges 41 to 43 but the guide rollers 20, 22 and 30 disposed on that side have treads 124 to 126 which are narrower than the guideways 127 to 129 defined by the bordering ledges 41 to 43. For this reason the guide rollers 20, 22; 30 are laterally displaceable in case of tolerances.

Figure 10:
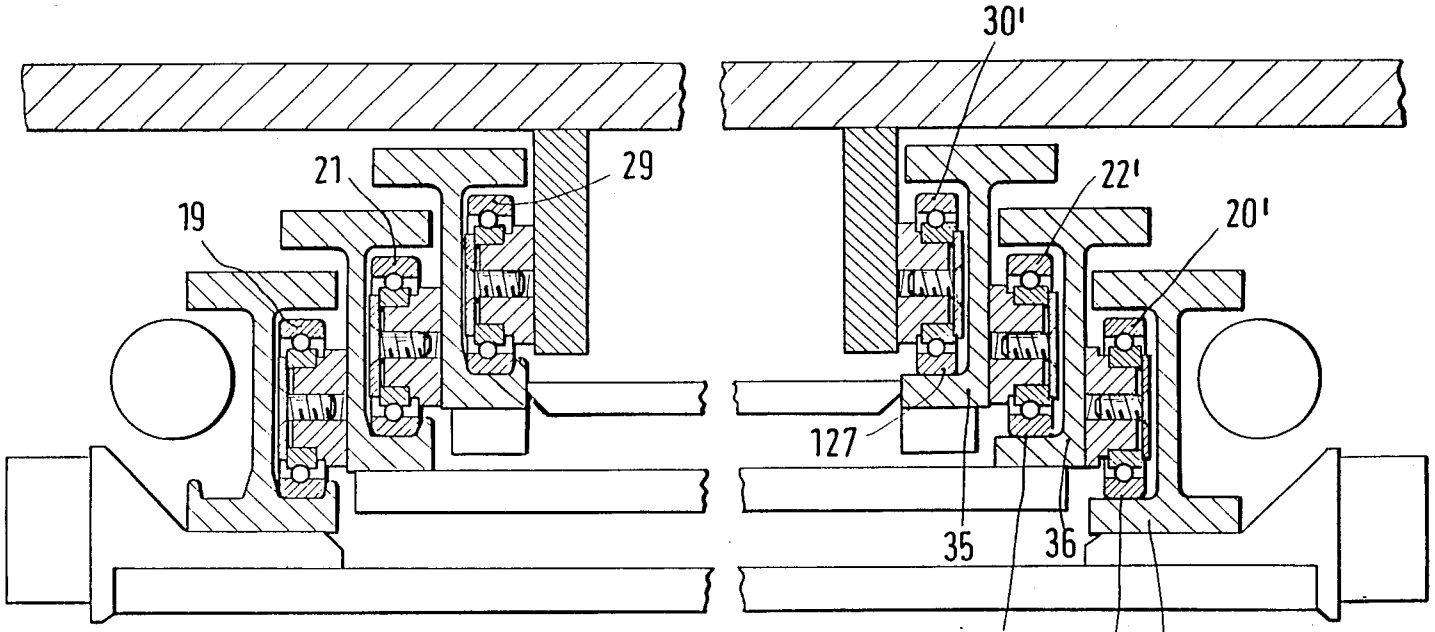
FIG. 10 is a view that is similar to FIG. 9 and shows a further embodiment in that position.

The embodiment shown in FIG. 10 corresponds to that of FIG. 9 with some modification. The design is the same on the left, on which the guide rollers 19, 21; 29 are laterally restrained on their guideways. In the embodiment shown in FIG. 10 one guide roller 20', 22' or 30' of each pair has the same width as the other roller of the same pair and said guide rollers are axially fixed in identical bearings. A lateral displacement is permitted in that the guideways 127 to 129 of the flanges 35 to 37 are smooth as far as to the inner edge of the flange so that said guideways are laterally open and the guide rollers 20', 22'; 30', which have the same width as the other guide rollers, can wander laterally and the pressure per unit of area will be kept constant.

Figure 11:
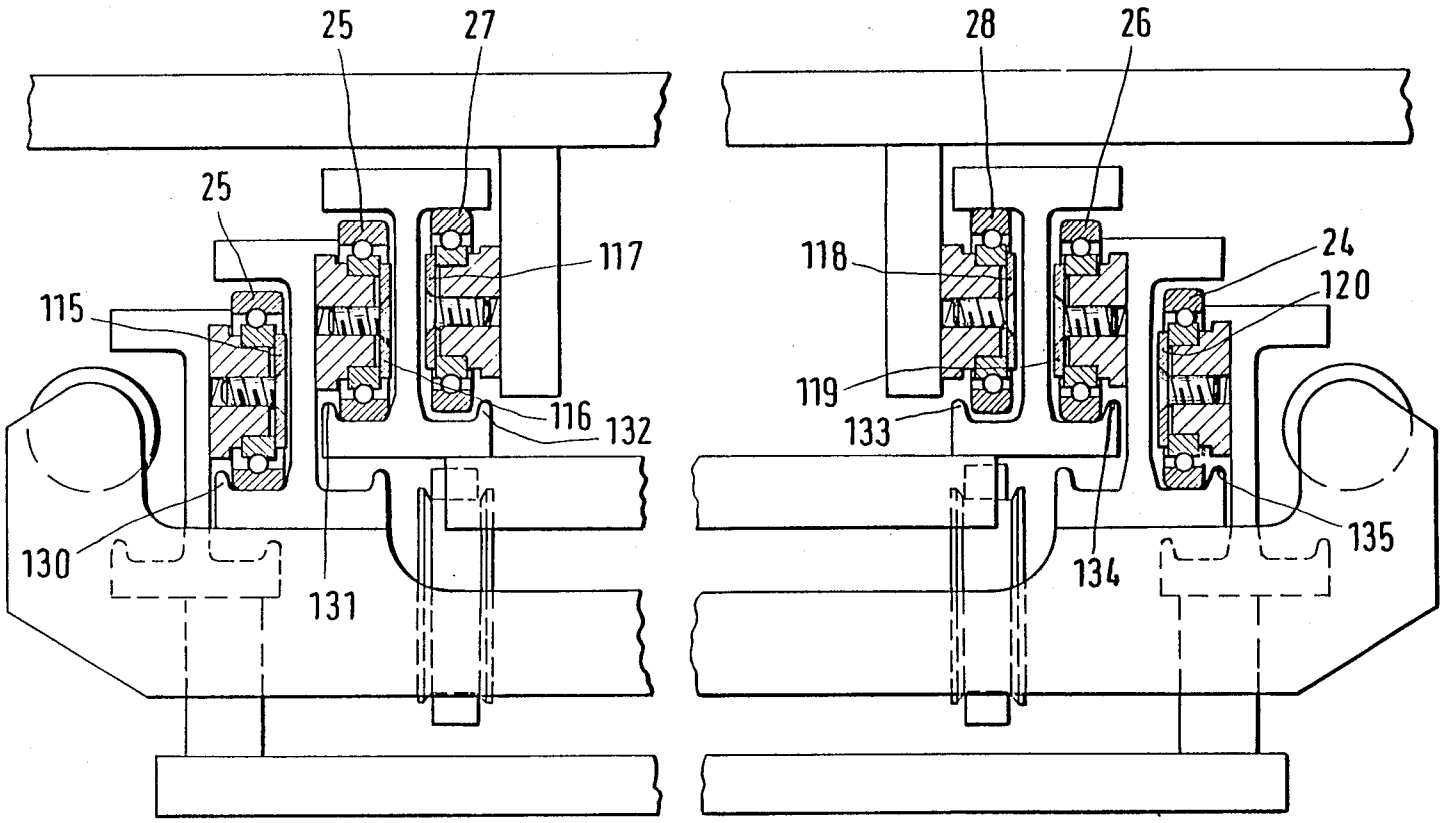
FIG. 11 is a view that is similar to FIG. 9 with the section taken in a plane in which the upper rollers of the retracted mast are disposed.

In the embodiment shown in FIG. 11 the upper guide rollers are shown in the positions assumed in the retracted mast. The guide rollers 23, 25, 27 disposed on one side are axially fixed in their bearings, the guide rollers 24, 26, 28 disposed on the other side are also axially fixed in their bearings, and the rollers which are at the top when the mast has been retracted are provided with the end washers 115 to 120. The bordering ledges 130 to 135 are also apparent. In that embodiment the guide rollers 23 and 25 are axially restrained between the bordering ledges 130, 131 whereas the guide rollers 24 and 26 to 28 are laterally movable between the associated bordering ledges 132 to 135 because the treads of said rollers are narrower than the associated guideways between the bordering ledges.

Figure 12:
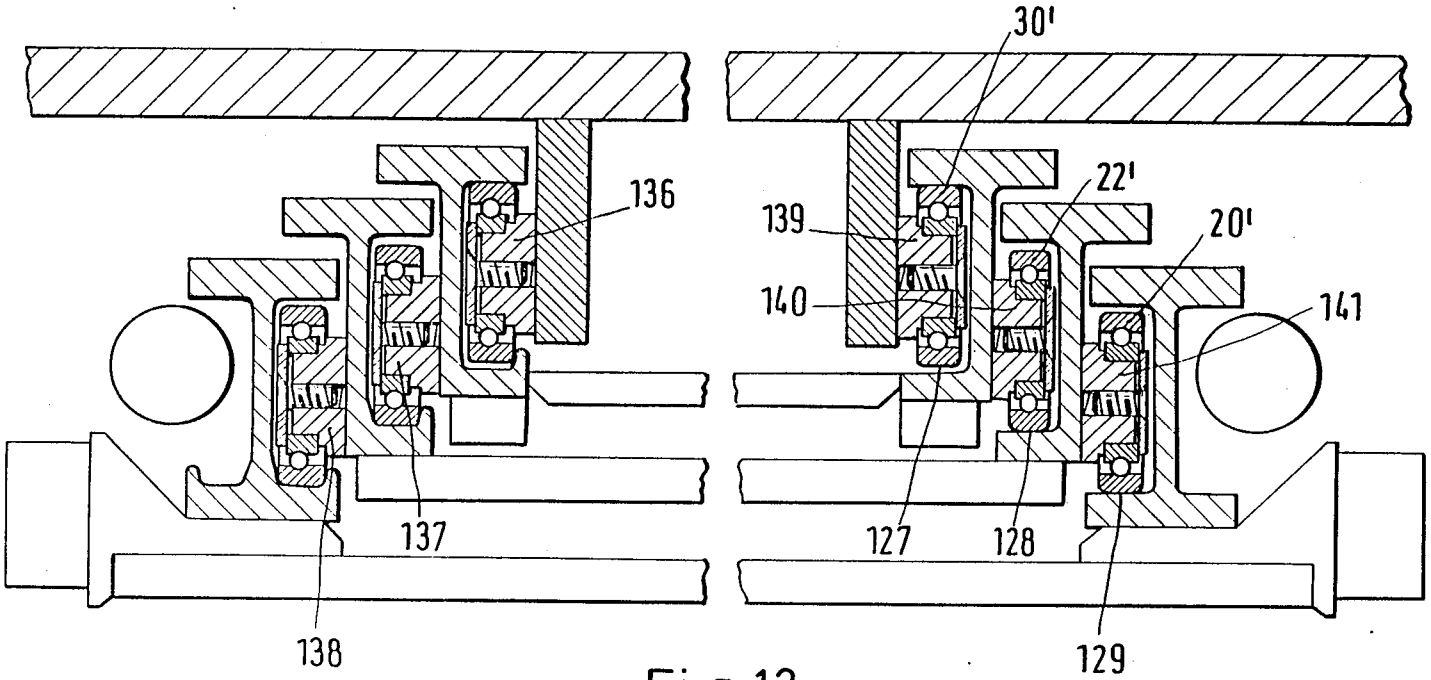

FIG. 12 is a view which corresponds to FIG. 11 but illustrates an embodiment which is basically the same as that shown in FIG. 10 in that the guideways 127 to 129 are laterally open.

On the right in FIG. 12 the guideways 127 to 129 are shown which are inwardly open, i.e., smooth throughout. Just as in FIG. 10, the guide rollers 20', 22' and 30' running on said guideways 127 to 129 have the same width as the guide rollers disposed on the other side so that they can laterally wander even though said guide rollers like all other guide rollers of that embodiment are axially fixed on their axles 136 to 141 by the above-mentioned end washers, which have been designated 115 to 120.

Figure 13:
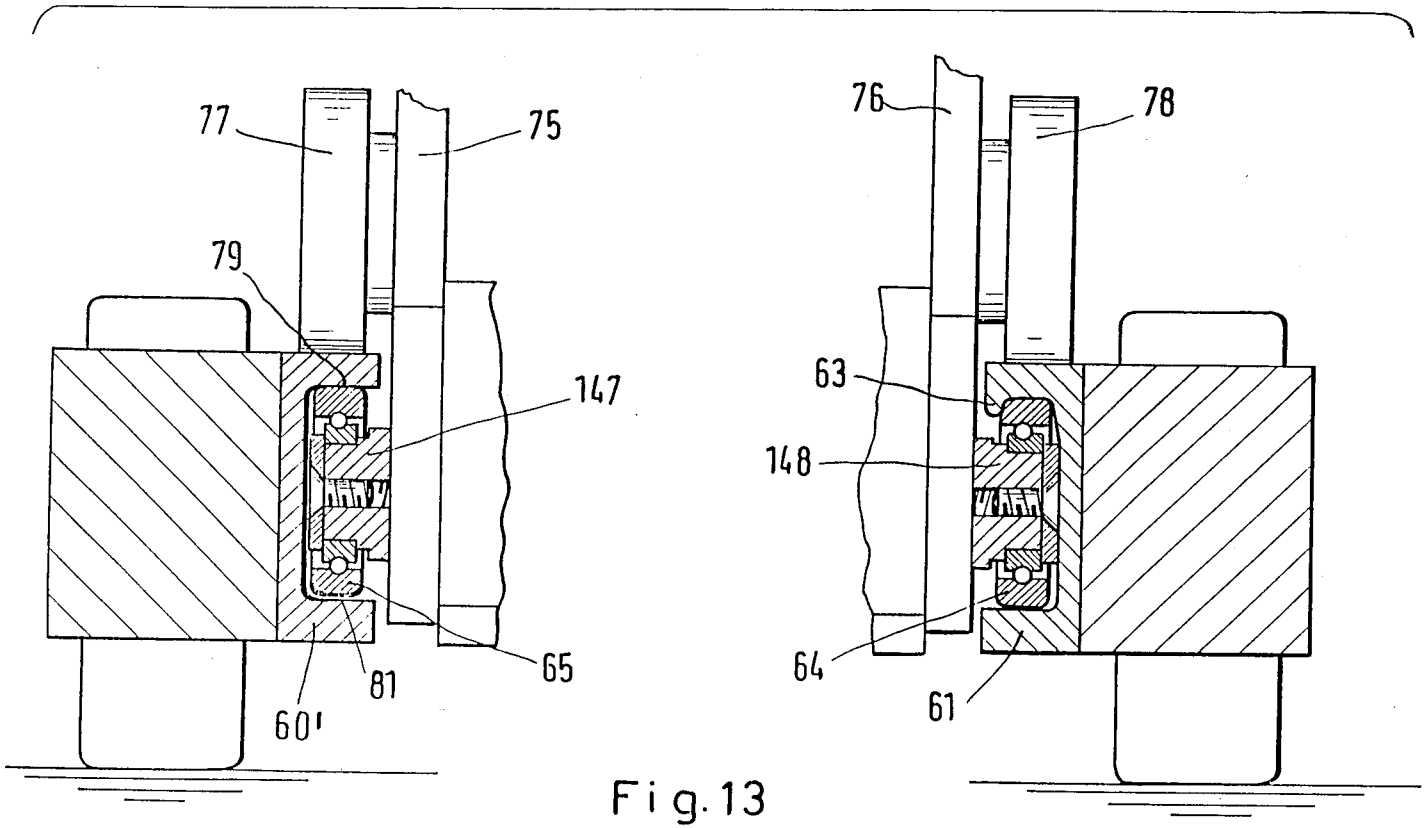
FIG. 13 is a diagrammatic fragmentary view that is drawn on a larger scale than FIG. 5 and in which parts have been broken away or shown in a section taken on line VI—VI in FIG. 5 and which illustrates an embodiment differing from that shown in FIG. 6.
Figure 14:
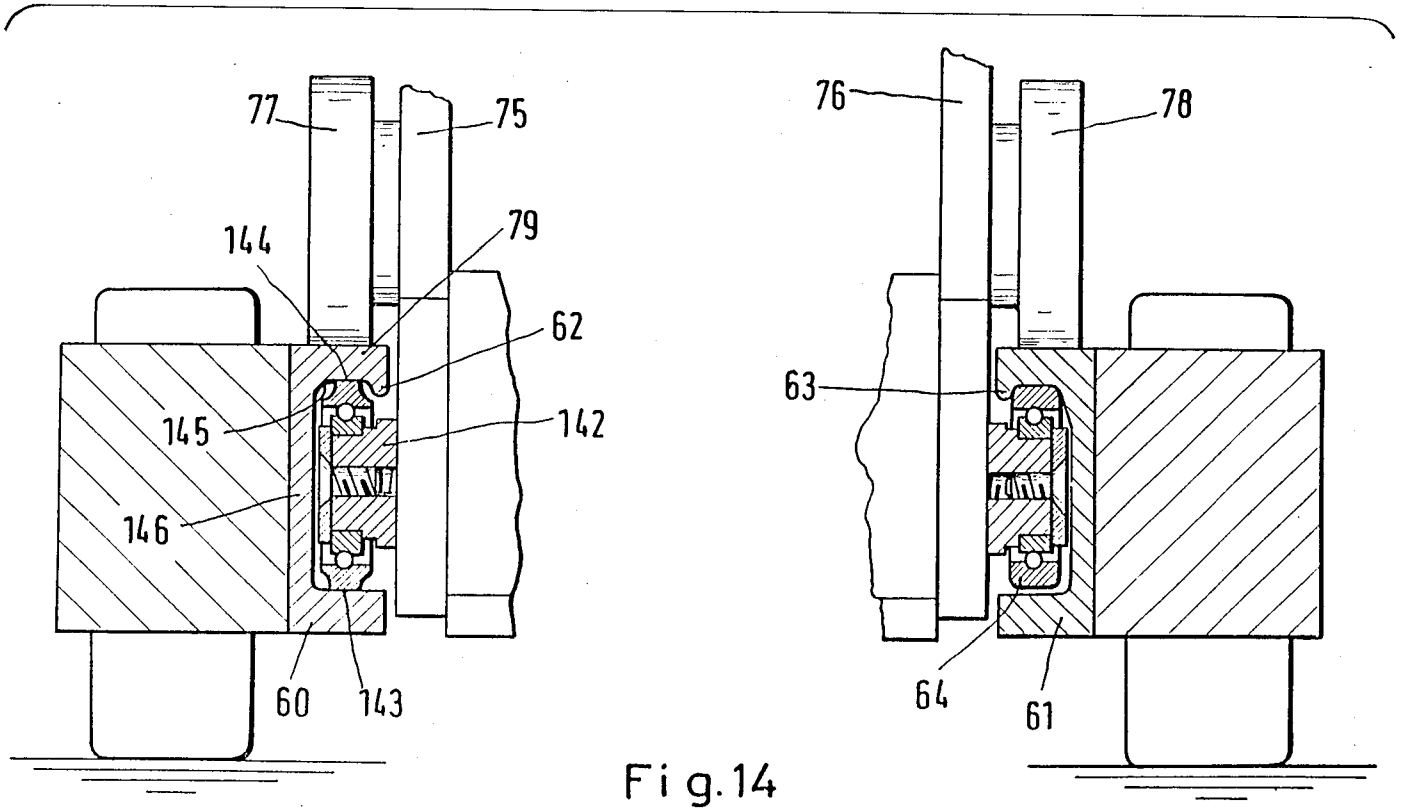
FIG. 14 is a diagrammatic fragmentary view that is drawn on a larger scale than FIG. 5 and in which parts have been broken away or shown in a section taken on line VI—VI and which illustrates a further embodiment differing from that of FIG. 13.

In the high-lift truck shown in FIGS. 5, 13 and 14 and comprising a displaceable mast is provided with horizontal guide rails 60, 61 which are inwardly open and are provided particularly on their top flanges with bordering ledges 62, 63 on the inside. The guide rollers 64, 65; 66, 67 roll in said guide rails. The guide rollers 64, 65 are shown also in FIG. 13. In accordance with FIG. 14, different guide rollers 143 may be provided on one side.

In the embodiment shown in FIG. 14, bordering ledges 62, 63 are provided on both guide rails 60, 61.

The backing rollers 77, 78 take up the load and ensure that the forward guide rollers 64, 65 and 143 will also be held against the top flange 79, 80 of the guide rails 60, 61.

FIGS. 13 and 14 show special details of the guiding means for the lifting frame which constitutes a displaceable mast. FIG. 13 shows guide rails 60', 61 and also shows guide rollers 64, 65 having the same width. But only the guide roller 64 in the guide rail 61 is laterally restrained by the bordering ledge 63. The guide roller 65 is laterally movable at the bottom on the flange 81 and the top flange 79 has a smooth guideway extending inwardly so that a lateral adjustment can be effected because the guide roller 65 can laterally wander between the flanges 79 and 81 on the guideways defined by them. The two guide rollers 64, 65 are rotatably mounted and axially fixed in bearing brackets 147, 148.

FIG. 14 shows the guide rails 60, 61 of FIG. 13. The guide rail 60 differs from the guide rail 60' in that it is designed in mirror symmetry to guide rail 61 and has a bordering ledge 62 associated with it.

The guide roller 64 running in the guide rail 61 is axially restrained by bordering means as described, the guide roller 65 is replaced by a guide roller 143, which is rotatably mounted and axially fixed in the bearing bracket 142 and has a tread 144 which is narrower than the guideway 145 formed on the top flange 79 between the web 146 of the guide rail 60 and the bordering ledge 62. For this reason the rotatably mounted and axially fixed guide roller 143 provided on that side can laterally wander to the defined extent, which is sufficient to permit a compensation of all tolerances to be expected.

We claim:

1. An industrial truck comprising a lifting frame and at least one vertically movable load-carrying carriage secured to said lifting frame, said lifting frame comprising a fixed mast section and at least one extensible mast section displaceable vertically relative to said fixed mast section, each of said fixed and said extensible mast sections comprises a pair of laterally disposed vertical rails, rotatably mounted guide rollers, each of said guide rollers has an axis of rotation extending generally horizontally and perpendicularly of the vertical rail and said fixed and said extensible mast sections each comprising a first rail and a second rail spaced apart in the horizontal direction and disposed in parallel relation, each of said first and second rails has a shaped guideway with said rollers mounted therein, cross-braces interconnecting said vertical rails, said rollers in said guideways of said first rails being fixed against axial displacement relative to the axis of rotation of said rollers, and said rollers in said second rails are retained within said guideways and are axially displaceable therein relative to the axis of rotation of said rollers, said guideways are U-shaped and face inwardly in said lifting frame, said U-shaped guideways having a base and a pair of spaced sides extending from said base inwardly relative to said lifting frame, at least one of said sides having a bordering ledge spaced from said base and extending toward the other said side of said U-shaped guideway, said first rails of said mast section located adjacent to one another and said second rails of said mast sections located adjacent to one another, and said first and second rails of said at least one extensible mast section being displaceable vertically relative to said first and second rails of said fixed mast section, each said guide rollers being located in one of said first and second rails and having a bearing secured to an adjacent one of said rails, said bordering ledges preventing said rollers from axial displacement out of said guideways and at least said bearings on said second rails affording axial displacement of said rollers in said guideways of said second rails.

2. An industrial truck comprising a lifting frame and at least one vertically movable load-carrying carriage secured to said lifting frame, said lifting frame comprising a fixed mast section and at least one extensible mast section displaceable vertically relative to said fixed mast section, each of said fixed and said extensible mast sections comprises a pair of laterally disposed vertical rails, rotatably mounted guide rollers, each of said guide rollers has an axis of rotation extending generally horizontally and perpendicularly of the vertical rail and said fixed and said extensible mast sections each comprising a first rail and a second rail spaced apart in the horizontal direction and disposed in parallel relation, each of said first and second rails has a shaped guideway with said rollers mounted therein, cross-braces interconnecting said vertical rails, said rollers in said guideways of said first rails being fixed against axial displacement relative to the axis of rotation of said rollers, and said rollers in said second rails are retained within said guideways and are axially displaceable therein relative to the axis of rotation of said rollers, said first and second rails each have a vertically extending U-shaped guideway therein having a base and a pair of spaced sides extending from said base toward the inside of said lifting frame, each of said guideways in said first and second rails having an inwardly projecting bordering ledge on at least one of said sides of said guideways spaced from the base thereof and projecting toward the other said side, said rollers in said first rails being secured by said bordering ledges against axial displacement in the axial direction of the axis of rotation of said rollers, and said rollers in said guideways in said second rails being in rolling contact with said sides of said guideways and said rollers in contact with said sides being narrower than said sides so that said rollers are axially displaceable within said guideways inwardly of said bordering ledges therein.

* * * * *